US006497259B1

(12) United States Patent
Wegman

(10) Patent No.: US 6,497,259 B1
(45) Date of Patent: Dec. 24, 2002

(54) FILLING APPARATUS HAVING A CLEAN-SHUTOFF CONVEYOR

(75) Inventor: Paul M. Wegman, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/021,033

(22) Filed: Dec. 19, 2001

(51) Int. Cl.[7] ..... B65B 1/04

(52) U.S. Cl. ..... 141/267; 141/67; 141/286; 141/256

(58) Field of Search ..... 141/59, 67, 65, 141/71, 66, 286, 44, 46, 47, 267, 256; 222/53, 152, 226

(56) References Cited

U.S. PATENT DOCUMENTS 6,021,821 A * 2/2000 Wegman ..... 141/129
6,196,278 B1 * 3/2001 Wegman et al. ..... 141/256
6,318,418 B1 * 11/2001 Grossmann et al. ..... 141/286

* cited by examiner

*Primary Examiner*—Steven O. Douglas
(74) *Attorney, Agent, or Firm*—Tallam I. Nguti

(57) ABSTRACT

An apparatus is provided for moving powder from a hopper containing a supply of powder to fill a container. The apparatus includes (a) a conduit member operably connected to the hopper and having a discharging end for permitting a powder to be moved therethrough; (b) a nozzle member for directing the powder from the conveyor to fill the container, the nozzle member being operably connected to the discharge end of the conduit member and having a first end connected to the conduit member, and a second and opposite end for dispensing moving powder into the container; and (c) a conveyor device located at least partially within the conduit member for moving the powder from the hopper in a powder moving direction to the nozzle member, the conveyor device being stoppable for halting the flow of powder, and including a porous portion and vacuum device for additionally halting the flow of powder for a clean shutoff.

4 Claims, 2 Drawing Sheets

FILLING APPARATUS HAVING A CLEAN-SHUTOFF CONVEYOR

RELATED APPLICATIONS

This application is related to U.S. application Ser. No. 10/021,031 (Applicants' Docket No. D/A1019) entitled "Filling Apparatus Having An Even-Filling Nozzle" filed on the same date herewith, and having at least one common inventor.

BACKGROUND OF THE INVENTION

This invention relates generally to apparatus for filling a container with dry particulate material, and more particularly concerns a filling apparatus having a clean shutoff conveyor for preventing undesirable dribble after filling a container with particulate materials such as toner.

Currently when filling particulate materials, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner/funnel friction.

Toner containers for small low cost printers and copiers typically have a small opening into which the toner is to be added. Furthermore, the toner containers often have irregular shapes to conform to the allotted space within the copying machine. Therefore it becomes difficult to fill the toner container because of the small tube required to fit into the small toner container opening and secondly for all the toner within the container to completely and evenly fill the remote portions of the container before the container overflows.

Some of the problems associated with controlling the filling of such toner containers are due primarily to the properties of the toner. Toner is the image-forming material in a developer which when deposited by the field of an electrostatic charge becomes the visible record. There are two different types of developing systems known as one-component and two-component systems.

In one-component developing systems, the developer material is toner made of particles of magnetic material, usually iron, embedded in a black plastic resin. The iron enables the toner to be magnetically charged. In two-component systems, the developer material is comprised of toner which consists of small polymer or resin particles and a color agent, and carrier is which consists of roughly spherical particles or beads usually made of steel. An electrostatic charge between the toner and the carrier bead causes the toner to cling to the carrier in the development process. Control of the flow of these small, abrasive and easily charged particles is very difficult.

The one-component and two-component systems utilize toner that is very difficult to flow. This is particularly true of the toner used in two component systems, but also for toner for single component systems. The toner tends to cake and bridge within the hopper. This limits the flow of toner through the small tubes which are required for addition of the toner through the opening of the toner container. Also, this tendency to cake and bridge may cause air gaps to form in the container resulting in partial filling of the container.

Attempts to improve the flow of toner have also included the use of an external vibrating device to loosen the toner within the hopper. These vibrators are energy intensive, costly and not entirely effective and consistent. Furthermore, they tend to cause the toner to cloud causing dirt to accumulate around the filling operation.

Other attempts made to effectively fill such toner containers have included use of adapters positioned on the end of the toner filling auger which has an inlet corresponding to the size of the auger and an outlet corresponding to the opening in the toner container. Clogging of the toner, particularly when attempting to increase toner flow rates and when utilizing toners with smaller particle size, for example, color toners having a particle size of 7 microns or less, has been found to be a perplexing problem. The adapters that are fitted to the augers, thus, tend to clog with toner. The flow rates through such adapters is unacceptably low.

SUMMARY OF THE INVENTION

In accordance with the present invention, there is provided an apparatus for moving powder from a hopper containing a supply of powder to fill a container. The apparatus includes (a) a conduit member operably connected to the hopper and having a discharging end for permitting a powder to be moved therethrough; (b) a nozzle member for directing the powder from the conveyor to fill the container, the nozzle member being operably connected to the discharge end of the conduit member and having a first end connected to the conduit member, and a second and opposite end for dispensing moving powder into the container; and (c) a conveyor device located at least partially within the conduit member for moving the powder from the hopper in a powder moving direction to the nozzle member, the conveyor device being stoppable for halting the flow of powder, and including a porous portion and vacuum device for additionally halting the flow of powder for a clean shutoff.

BRIEF DESCRIPTION OF THE DRAWINGS

In the detailed description of the drawings presented below, reference is made to the drawings in which.

DETAILED DESCRIPTION OF THE INVENTION

Figure 1:
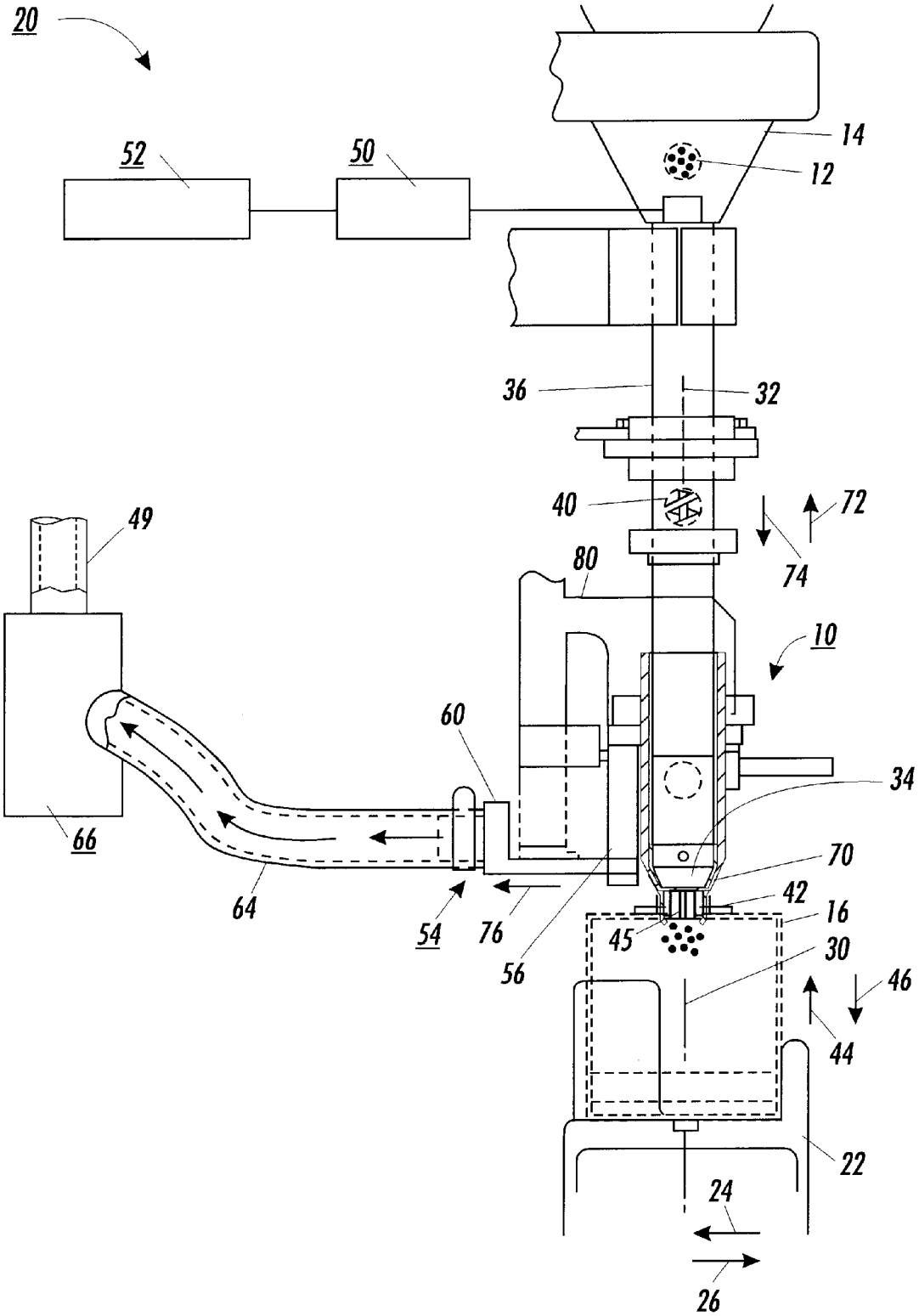
FIG. 1 is an elevational view of a powder container filling system partially in section utilizing the clean shutoff auger of the present invention.
Figure 2:
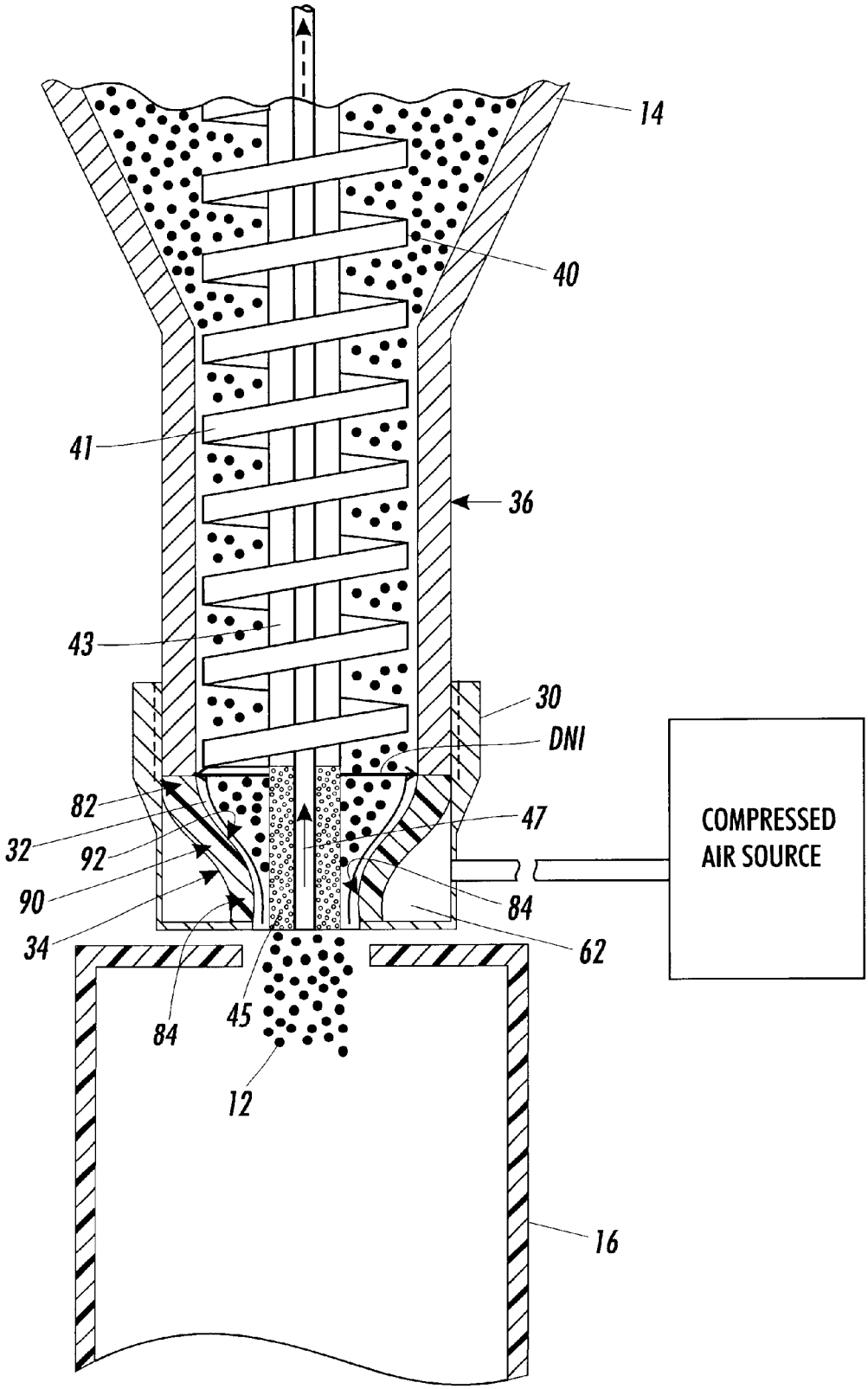
FIG. 2 is a cross-sectional schematic view of the clean shutoff auger of the present invention.

According to the present invention and referring now to FIG. 1, powder filling assisting apparatus 10 is shown. The powder filling assisting apparatus 10 is used to convey powder 12 in the form of toner for use in a copier or printer from a hopper 14 to a container 16. The powder filling apparatus 10 is mounted to filling line 20 to permit for the filling of large production quantities of containers 16, the container 16 is mounted to a carrying device 22. The device 22 is movable in the direction of either arrow 24 or 26. The carrying device 22 serves to position container centerline 30 in alignment with apparatus centerline 32.

The powder filling assisting apparatus 10 includes an even-filling nozzle 34 (in accordance with the present invention, and to be described in detail below) which is used to direct the powder 12 into the container 16. The even-filling nozzle 34 is connected to the hopper 14 by means of a conduit 36 in the form of a hollow tube or funnel.

As shown in FIG. 1, the hopper 14 is positioned above the container 16 whereby gravity will assist in the flow of powder 12 toward the container 16. To optimize the flow of powder 12 toward the container 16, the powder filling apparatus 10 further includes a conveyor 40 positioned at least partially within the conduit 36 for assisting in the flow of the powder 12. The conveyor 40 is in the form of a spiral conveyor or auger. For example, the auger 40 may be in the form of a spiral shaped auger, which may include various geometries, such as, a straight or tapered helical screw. The auger closely conforms to the conduit.

The even-filling nozzle 34 is insertable into opening 42 of the container 16. The insertion of the even-filling nozzle 34 in the opening 42 may be accomplished in any suitable method. For example, the carrying device 22 and, consequently, the container 16 may be movable upward in the direction of arrow 44 for engagement with the even-filling nozzle 34 and downward in the direction of arrow 46 for disengagement from the opening 42. The upward and downward motion of the device 22 and the container 16 permits the container 16 to be indexed in the direction of arrows 24 and 26.

Provisions are made to assure that the filling line 20 is free from airborne powder 12 which may escape between the even-filling nozzle 34 and the opening 42 of the container 16 during the filling operation and in particular during the indexing of the carrying device for presenting an unfilled container 16 to the powder filling apparatus 10. A clean filling system 54 is shown in FIG. 1 for use with the apparatus 10. The clean filling system is secured to filling line 20 as well as to the conduit 36, and may be used to support slide 60. Slide 60 is connected to a tray or toner drip plate (not labeled) which slidably is fitted between the even-filling nozzle 34 and the opening 42. The tray or drip plate in this position acts to prevent the spilling of powder 12 during the indexing of the containers 16. A housing 56 which surrounds part of the even-filling nozzle 34, provides a cavity or chamber 62 which is sealed when the tray or drip plate is in its closed position. The chamber 62 is kept under vacuum via a toner dust vacuum line 64 to a vacuum source 66.

As shown, the auger 40 is rotatably secured within the conduit 36, and may float within the conduit 36 or be supported to the conduit 36 at its distal ends. The auger 40 may be of any particular configuration but preferably is a spiral auger including flights 41 and an auger shaft 43. The auger 40 as such is rotatable at a suitable speed to optimize the flow of powder 12 through the nozzle 34. The auger 40 may be rotated by any suitable method, i.e. by motor 50 operably connected to the auger 40. The motor 50 is connected to a controller 52 which sends a signal to the motor 50 to stop the rotation of the auger 40 during indexing of the carrying device 22.

It should be appreciated, however, that the flow of powder 12 through the conduit 36 may be further controlled by the use of a valve therein (not shown).

In order to permit the filling of a number of containers 16, the flow of powder 12 from the hopper 14 must be halted during the indexing of a filled container 16 from the fill position and during the indexing of the unfilled container 16 toward the filling position. As shown, the flow of powder 12 may be halted by the stopping of auger 40 within the conduit 36. Additionally as shown, the auger 40 includes a porous portion such as the discharge tip 45 through which a vacuum can be pulled, thereby greatly enhancing stoppage of powder flow after halting the auger 40 and providing a clean shutoff. Vacuum 47 can be applied to the porous auger tip 45 through a vacuum line 49 that is connected to the vacuum source 66 (FIG. 1) and under the control of the controller 52. Any portion of the auger, not limited to the tip 45, may be porous By making a portion, the tip 45 of the auger 40 porous and applying a vacuum 47 to it, toner is captured more securely when it is necessary to stop filling, thus resulting in a clean shutoff after a filling cycle. Vacuum can also be applied in combination to the nozzle itself. Such a combination creates a highly reliable, magnetic or non-magnetic toner filling system for a fast and clean fill. The porous auger tip 45 and the nozzle 34 function by evacuating the air between the toner particles that are near the tip of the auger 40, at the end of the filling cycle. With the absence of air, toner effectively and positively bridges any flow passages. This creates a blockage for other toner attempting to dribble within the system, and so prevents such toner from falling out of the system. The vacuum 47 to the auger 40 is shut off when the next cartridge or container 16 is in position and just prior to the start of the next filling cycle. A short burst of compressed air may be used to clear the nozzle and auger between cycles if required.

A vacuum valve assembly (not shown) may also be provided for evacuating the air between the particulate 12 particles, that are near the tip of auger 40, at the end of the filling cycle.

As can be seen, there has been provided an apparatus for moving powder from a hopper containing a supply of powder to fill a container. The apparatus includes (a) a conduit member operably connected to the hopper and having a discharging end for permitting a powder to be moved therethrough; (b) a nozzle member for directing the powder from the conveyor to fill the container, the nozzle member being operably connected to the discharge end of the conduit member and having a first end connected to the conduit member, and a second and opposite end for dispensing moving powder into the container; and (c) a conveyor device located at least partially within the conduit member for moving the powder from the hopper in a powder moving direction to the nozzle member, the conveyor device being stoppable for halting the flow of powder, and including a porous portion and vacuum device for additionally halting the flow of powder for a clean shutoff.

While the embodiment of the present invention disclosed herein is preferred, it will be appreciated from this teaching that various alternative, modifications, variations or improvements therein may be made by those skilled in the art, which are intended to be encompassed by the following claims:

I claim:

1. An apparatus for moving powder from a hopper containing a supply of powder to fill a container, the apparatus comprising:

(a) a conduit member operably connected to the hopper and having a discharging end for permitting a powder to be moved therethrough;

(b) a nozzle member for directing the powder from said conveyor to fill the container, said nozzle member being operably connected to said discharge end of said conduit member and having a first end connected to said conduit member, and a second and opposite end for dispensing moving powder into the container; and (c) a conveyor device located at least partially within said conduit member for moving the powder from the hopper in a powder moving direction to the nozzle member, said conveyor device being stoppable for halting the flow of powder, and including a porous portion and vacuum means for additionally halting the flow of powder for a clean shutoff.

2. The apparatus of claim 1, wherein said conveyor device is an auger including flights and an auger shaft.

3. The apparatus of claim 2, wherein said porous portion comprises a discharge tip.

4. The apparatus of claim 2, wherein said vacuum means include a vacuum line through said auger shaft that communicates with the porous portion.

* * * * *